US005979707A

United States Patent [19]

Bodin et al.

[11] Patent Number: 5,979,707

[45] **Date of Patent: *Nov. 9, 1999**

[54] BOTTLE FOR DISPENSING FLUID, COMPRISING A FLEXIBLE BAG, AND METHOD OF MANUFACTURE

[75] Inventors: Jacques Bodin, Levallois-Perret; Daniel Crosnier, Offranville, both of France

[73] Assignee: Labcatal, Montrouge, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/817,647

[22] PCT Filed: Sep. 4, 1996

[86] PCT No.: PCT/FR96/01350

§ 371 Date: Apr. 30, 1997

§ 102(e) Date: Apr. 30, 1997

[87] PCT Pub. No.: WO97/09124

PCT Pub. Date: Mar. 13, 1997

[30] Foreign Application Priority Data

Sep. 5, 1995 [FR] France ..... 95 10398

[51] Int. Cl.[6] ..... B65D 35/28

[52] U.S. Cl. ..... 222/95; 222/105; 222/321.7; 222/386.5

[58] Field of Search ..... 222/95, 105, 321.7, 222/385, 386.5

[56] References Cited

U.S. PATENT DOCUMENTS

| | | | |
|---|---|---|---|
| 3,992,003 | 11/1976 | Visceglia et al. | 222/386.5 |
| 5,135,137 | 8/1992 | Rudick | 222/105 |
| 5,139,168 | 8/1992 | Gueret | 222/92 |
| 5,292,033 | 3/1994 | Gueret | 222/95 |
| 5,556,005 | 9/1996 | Banks | 222/105 |

FOREIGN PATENT DOCUMENTS

| | | |
|---|---|---|
| 2668756 | 5/1992 | France . |
| 2685285 | 6/1993 | France . |
| 2710612 | 4/1995 | France . |

*Primary Examiner*—Joseph A. Kaufman
*Attorney, Agent, or Firm*—Foley & Lardner

[57] ABSTRACT

Bottle for dispensing fluid comprising a rigid container including an opening with a neck and a separable base. A flexible bag intended to contain the product in fluid form is placed inside the container. The diameter of the neck of the flexible bag is greater than the diameter of the neck of the rigid container, and the neck of the bag has an external flange with a diameter greater than that of the bag and less than the inside diameter of the container. The flexible bag may be filled before or after assembly, and may be used in the dispensing of products in fluid form, especially in the pharmaceutical field.

13 Claims, 2 Drawing Sheets

2
3
13

F
7
2
13
17

14
16
13
17

BOTTLE FOR DISPENSING FLUID, COMPRISING A FLEXIBLE BAG, AND METHOD OF MANUFACTURE

BACKGROUND OF THE INVENTION

1. Field of the Invention

The present invention relates to a bottle for dispensing fluid, and more particularly a bottle of the type comprising a container, a flexible bag and a pump, for dispensing a product in fluid form stored so that it is protected from the air, and also to a method of manufacture.

2. Description of the Related Art

In the field of bottles for dispensing fluid, liquid or pasty products, the technique which consists in placing a flexible and deformable bag inside a bottle, the assembly being completed by an extraction pump or valve, is known. The bag is generally filled with the fluid after the bag and the bottle have been put together, and a gas may be introduced between the bag and the internal surface of the bottle so as to cause a determined amount of product to leave the bag upon actuation of the valve. In another technique, the space between the bag and the internal wall of the bottle communicates with the outside via a vent so as to maintain a pressure on the wall of the bag to make it easier to extract the product.

It has not been possible to develop any satisfactory technique for filling the bag before assembling it with the bottle. Although filling can be carried out more quickly in this case, putting together a previously-filled bag and a rigid bottle intended to contain it is extremely tricky, and this is why the conventional techniques consist in carrying out the filling after the bag and the bottle have been put together, despite the inherent drawbacks with these techniques. In particular, the neck of the bottle of the flexible bag has to be matched to the diameter of the pump used to extract the contents from the bag; the result of this is that the diameter of the neck is relatively narrow, which limits the rate at which the bag can be filled.

In such devices, use is often made of pumps which extract by suction without introducing air into the bag to compensate for the volume sucked out, the bag, which is made of elastically deformable material, progressively deforming as its volume reduces. The pump has to be put in place after the bag has been filled, and this leads to the presence of a certain volume of air in the upper part of the bag, which takes away from the accuracy and reliability of operation of the dispensing bottle. In particular, these devices are ill-suited to dispensing bottles for pharmaceutical products for which good uniformity of operation is indispensable.

Thus the patent FR-A-2.710.612 describes a dispensing bottle of the aforementioned type, comprising a flexible bag, a pump fixed on the neck of the bag, and a rigid casing in which is placed the bag, the neck of which protrudes above the upper edge of the base of the casing and is surrounded by a rigid cover secured to the base.

A dispensing bottle of the same type is described in patent FR-A-2.658.793, according to which the flexible bag contains a mesh intended to prevent the walls of the bag from sticking together. However, this device does not allow the bag to be emptied completely.

The patent FR-A-2.685.285 describes a rigid bottle into which a flexible bag has been introduced, which bag is then filled with a liquid product, then a pump without an air inlet is mounted on the inlet orifice of the bag and of the bottle.

The patent FR-A-2.668.756 relates to a method of producing a rigid bottle containing an elastically deformable bag, which is filled after the bag and the bottle have been put together. According to this patent, the pump, which operates by suction without introducing any compensating air into the bag, is put in place on the neck of the bag before the latter is introduced into the rigid bottle.

The patent FR-A-2.682.667 describes a stoppering device fitted to the opening of a receptacle, and associated with a metering device and with a brush, for example for applying nail varnish.

SUMMARY OF THE INVENTION

The subject of the present invention is a bottle designed to dispense product in fluid form, for example a liquid mixture for atomizing, of the type comprising a rigid container containing a flexible bag, on the neck of which a pump is mounted, that can be filled before or after the bag and container are/have been put together and before or after the fitting of the pump.

Another subject of the invention is a bottle for dispensing fluid product which can be manufactured and filled in a simple and effective way, while at the same time ensuring that the product in the flexible bag is kept out of contact with the air (system known as "airless").

Finally, a further subject of the invention is a method for the manufacture of such a bottle by putting together a flexible bag, container and a pump, the method allowing the flexible bag to be filled before or after assembly.

The dispensing bottle according to the present invention is suitable for dispensing all products in fluid, especially liquid or pasty, form, for example liquids, creams or emulsions of varying viscosity, for industrial, cosmetic or pharmaceutical uses, and most specifically for dispensing bottles for pharmaceutical products delivered in the form of an atomized spray, a mist or an aerosol.

The bottle for dispensing a product in fluid form in accordance with the present invention comprises

- a rigid container including an opening with a neck;
- a flexible bag intended to contain the product in fluid form, this bag being placed inside the container;
- a pump for extracting the fluid in the bag;

and its distinguishing features are that

- the diameter of the neck of the flexible bag is greater than the diameter of the neck of the rigid container, and
- the neck of the bag has an external flange with a diameter greater than that of the bag.

As a preference, the neck of the rigid container has an extension protruding into the volume of the container, delimiting a space between its external face and the internal wall of the container. According to a preferred embodiment, the extension of the neck of the container protrudes inside the flexible bag, and, in addition, the internal face of the neck of the flexible bag is in contact with the external face of the extension.

The bottle according to the invention consists of two parts, a main cylindrical part and a base, which are separable and are put together at the end of manufacture, as indicated later. The volume between the rigid container and the flexible bag communicates with the outside through a vent preferably provided in the base of the container.

According to an additional feature of the present invention, the bottle includes a pump for extracting the fluid contained in the bag, and this pump is fixed on the neck of the container, whereas in common flexible-bag devices of the state of the art, the pump is generally fixed on the neck of the bag.

According to an advantageous embodiment of the invention, the bag and the container containing it are made of one and the same substance, for example polypropylene, as appropriate containing the conventional additives to make the container suitably rigid and to give the bag satisfactory flexibility and suppleness. The mechanical properties desired for the container and for the bag (rigidity and flexibility) may also be obtained by selecting specific wall thicknesses, keeping the same basic substance.

As indicated above, the invention also extends to a method of manufacturing a bottle of the type described above, the method allowing the flexible bag to be filled before or after the flexible bag and the rigid container are/have been put together.

The distinguishing features of this method are that: a) the flexible bag is introduced into an open cylindrical support of inside diameter slightly greater than the outside diameter of the flexible bag, and of outside diameter slightly smaller than the outside diameter of the flange of the bag, and, if appropriate, the bag is filled; b) the upper cylindrical part of the rigid container, without its base, is put in place over the cylindrical support until it comes into contact with the flange of the flexible bag, and the bag is fixed to the container; c) and finally, the assembly consisting of the bag and the upper cylindrical part of the rigid container is removed from the cylindrical support and the base of the container is fixed to the lower edge of its cylindrical part.

According to this method, the bag can be filled just as easily before or after the bag and the container are/have been put together.

More specifically, the bottle with flexible bag according to the present invention is manufactured and filled as indicated below.

a) the first step is that the flexible bag, manufactured using a conventional method, for example by injection blow molding of polypropylene or of polyethylene, is placed on a hollow cylindrical support in such a way that the flange of the neck of the bag rests on the upper edge of the cylindrical support. The outside diameter of the cylindrical support is slightly smaller than the inside diameter of the container, and its inside diameter is such that its wall is against the surface of the bag.

b) the second step is that the cylindrical main part of the rigid container, without its base, is inserted over the cylindrical support holding the bag, until the neck of the bag comes into contact with the internal wall of the container, above the lower end of the extension of the neck of the container, then the bag is secured to the rigid container using a conventional technique, for example bonding, welding, snap-fastening or the like.

c) the third step is that the cylindrical support for the bag is removed, and the base of the container is fitted using a conventional method.

According to an alternative form in accordance with the invention, the bag is filled in an intermediate step a1), before the flexible bag is fixed to the rigid container.

As a preference, the pump is fixed on the neck of the rigid container before step b) of putting the container and the bag together.

According to another alternative form, filling is carried out after the bag and the container have been put together.

The first alternative form above is particularly advantageous because it allows the bag to be filled easily and quickly. Furthermore, the degree of filling is optimal, and can be greater than 90% of the total available volume of the bag after assembly.

BRIEF DESCRIPTION OF THE DRAWINGS

The features and advantages of the present invention will emerge in greater detail from the description which follows, which relates to a preferred and nonlimiting embodiment with reference to the appended drawings which represent.

DESCRIPTION OF SPECIFIC EMBODIMENTS

Figure 1:
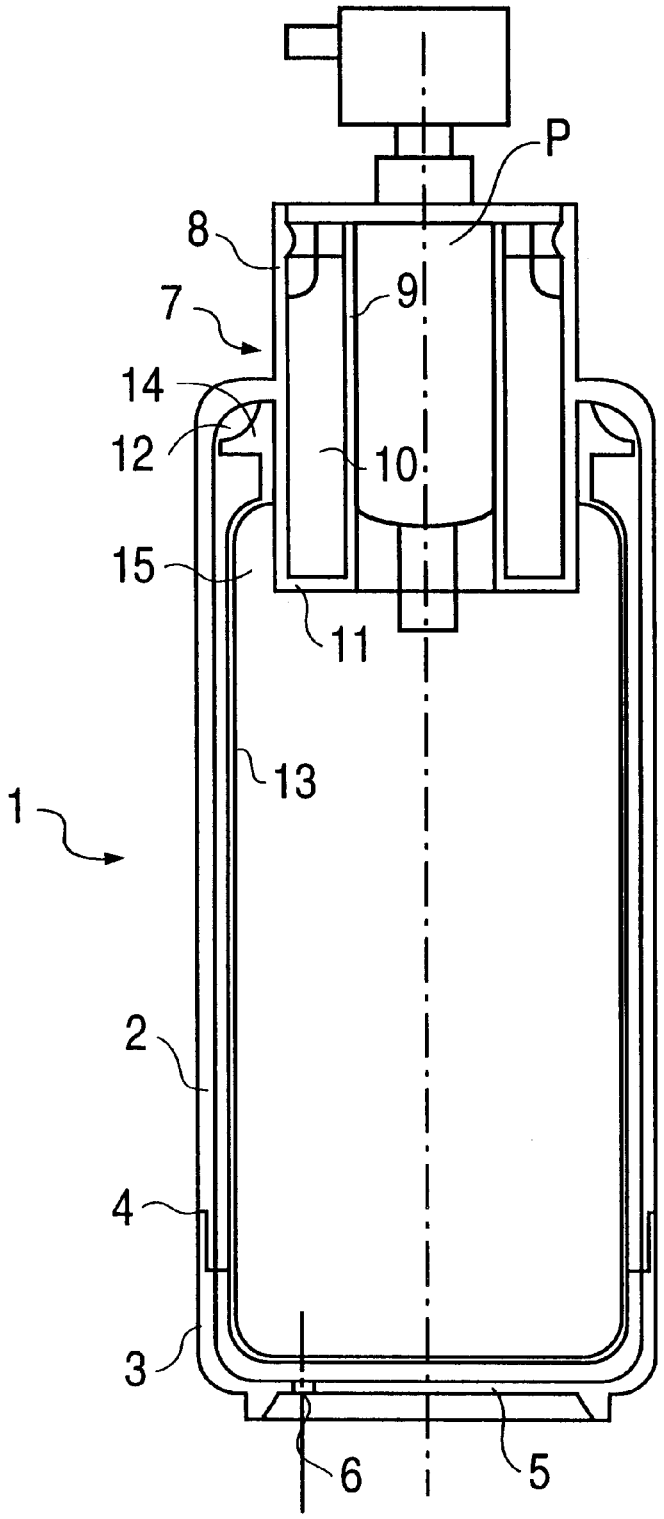
FIG. 1: a diagrammatic sectional view of a bottle according to the invention, comprising a flexible bag inside a rigid container.

As shown in FIG. 1, the bottle according to the invention consists of a container (1) comprising a cylindrical upper part (2) which is open at both ends and a base (3) which can be fixed on the upper cylindrical part (2) by any conventional means such as screwing, push-fitting, bonding, welding, etc. The base (3) has the shape of a cylinder which is open on just one side, and its bottom (5) has a vent (6).

The cylindrical part (2) at its upper part has a neck (7) with a double wall (8, 9) forming an annular throat (10) which is open at the top. The lower part of this double neck (7) protrudes into the volume of the cylindrical part (2) of the container (1) and forms an extension (11) which with the internal wall of this cylindrical part forms an annular volume (12) which is open at the bottom.

The container (1) contains an elastically deformable flexible bag (13), the neck (14) of which is housed in the annular volume (12), the internal surface of the neck (14) of the bag (13) being in contact with the surface of the lower part of the neck (7). The height of the neck (14) of the bag (13) is less than the height of the lower part of the neck (7) of the container so as to leave an annular volume (15) which is open at the bottom, between the internal wall of the bag (13) and the bottom of the neck (7) of the container (1).

The neck (14) of the flexible bag (13) has a flange (16) of diameter slightly greater than that of the flexible bag (13) but less than the inside diameter of the container (1). Thus the flange (16) protrudes slightly beyond the cylindrical section of the bag, and the purpose of this arrangement is to allow assembly and, as appropriate, filling, as indicated later.

The neck (14) of the bag (13) may be relatively rigid while the wall of the bag is made of an elastically deformable flexible substance, preferably polypropylene. The same substance is used for the entire bag, the greater rigidity of the neck being obtained using a greater thickness.

Figures 2A, 2B, 2C:
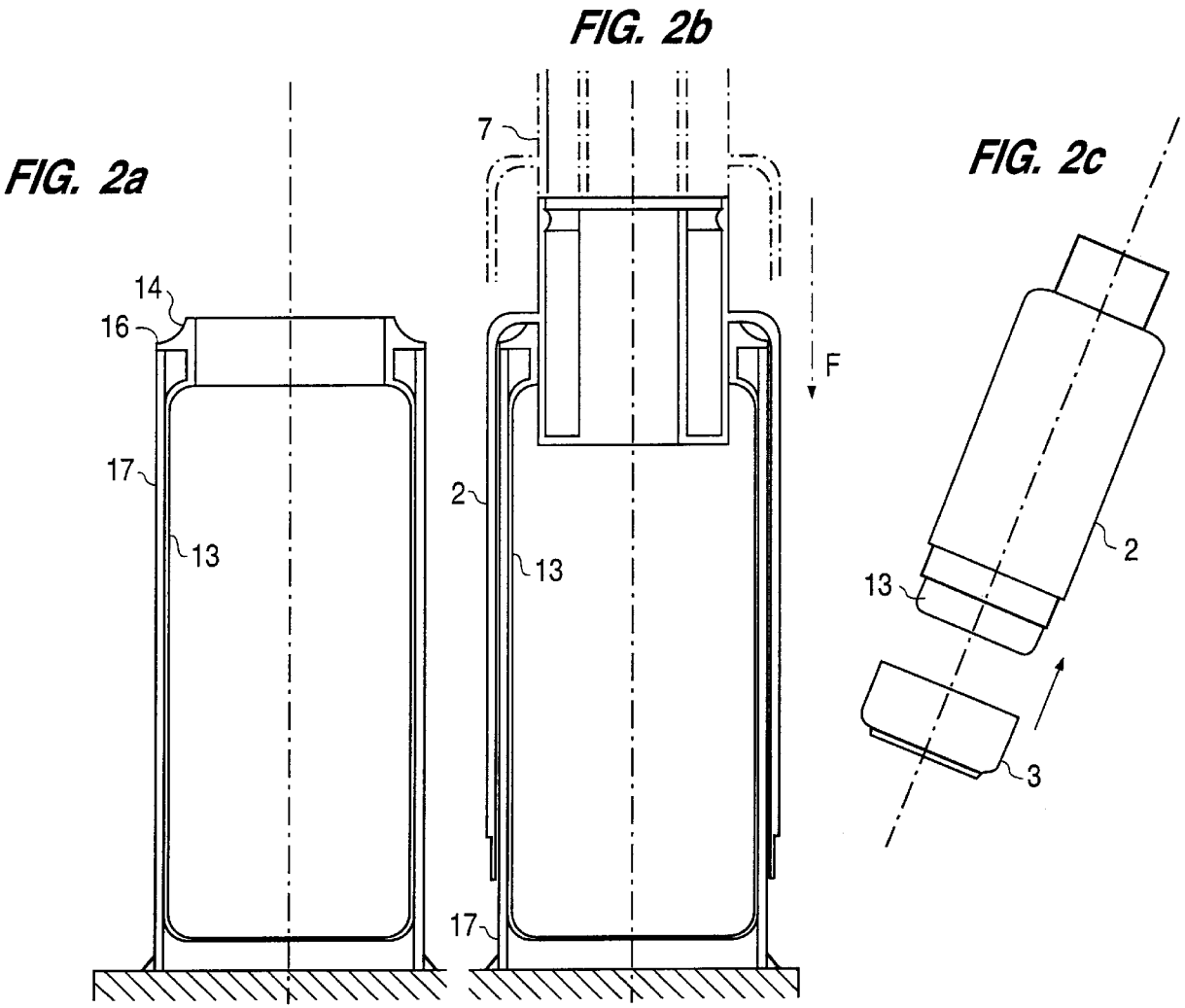
FIG. 2*a*: a diagrammatic sectional view of the support for filling and/or for assembling the flexible bag with the rigid container, before assembly.
FIG. 2*b*: a diagrammatic view of the step of fixing the bag to the container, the bag support still being in place.
FIG. 2*c*: a diagrammatic view of the last step of the manufacture by fixing the base of the container.

The manufacture and filling of the bottle are represented diagrammatically in FIGS. 2*a*, 2*b* and 2*c*.

As shown by FIG. 2*a*, the flexible bag (13) is put in place on a rigid cylinder (17) which is open at its top so that the bag rests via the edge of its flange (14) on the upper edge of the opening of the cylinder (17). Filling may be carried out, if desired, in this position, using a conventional device (not represented).

Next, using suitable tooling capable of handling and of shifting objects from one place to another, the cylindrical upper part (2) of the rigid container (1) is engaged with a vertical movement over the cylinder (17) containing the flexible bag (13). The drawing in dotted line in FIG. 2*b* represents the position of the cylindrical part (2) before it is put in place over the cylinder (17) with the movement indicated by the arrow (F). The cylindrical part (2) is engaged until it comes into contact with the flange (14) of the flexible bag (13).

This cylindrical part (2) is then fixed to the flange (14), for example using ultrasound welding. Then, using the same tooling as used for fitting the cylindrical part (2), the assembly consisting of the cylindrical part (2) and of the flexible bag (13) put together are lifted up in order to take them off the support cylinder (17).

The base (3) of the bottle (1) is then snap-fitted onto the cylindrical part (2) as represented in FIG. 2*c*.

When filling is carried out before the flexible bag (13) and cylindrical part (2) of the container (1) are put together, the pump may be fixed on the neck (7) of the container (1) before or after the latter is/has been put in place on the flexible bag (13) as represented in FIG. 2*b*.

What is claimed is:

1. Bottle for dispensing a product in fluid form, comprising:

a rigid container comprising a main part having an opening with a neck integral to the main part and a base separable from the main part, wherein the neck has an extension protruding into the volume of the rigid container, delimiting a space between an external face of the neck extension and an internal wall of the container;

a flexible bag intended to contain the product in fluid form, the bag being placed inside the container and the bag having a neck; and a pump for extracting the product in the bag;

wherein the diameter of the neck of the flexible bag is greater than the diameter of the neck of the rigid container, and the neck of the bag has an external flange with a diameter greater than the diameter of the bag and less than the inside diameter of the container.

2. The bottle according to claim 1 wherein the extension of the neck of the container protrudes inside the flexible bag.

3. The bottle according to claim 1 wherein the neck of the flexible bag is fixed to the container between the external face of the extension and the internal wall of the container.

4. The bottle according to claim 3 wherein the internal face of the neck of the flexible bag is in contact with the external face of the extension.

5. The bottle according to claim 1 wherein the pump is fixed on the neck of the rigid container.

6. The bottle according to claim 1 wherein the container and the bag are made of the same material.

7. Method of manufacturing a bottle according to claim 1 comprising:

introducing the flexible bag into an open support cylinder of inside diameter slightly greater than the outside diameter of the flexible bag, and of outside diameter slightly smaller than the outside diameter of the flange of the bag, and, if appropriate, the bag is filled;

placing the main part of the rigid container, without its base, over the cylinder until it comes into contact with the flange of the flexible bag and the bag is fixed to the container;

removing the assembly consisting of the bag and the main part of the rigid container from the support cylinder; and fixing the base of the container to the lower edge of the main part.

8. The method according to claim 7 wherein the flexible bag is filled with the product in fluid form before the placing step.

9. Bottle for dispensing a product in fluid form, comprising:

a rigid container comprising a main part having an opening with a neck integral to the main part and a base separable from the main part, wherein the neck has an extension protruding into the volume of the rigid container, delimiting a space between an external face of the neck extension and an internal wall of the container; and a flexible bag for containing the product in fluid form, the bag being placed inside the container, the bag having a neck;

wherein the diameter of the neck of the flexible bag is greater than the diameter of the neck of the rigid container, and the neck of the bag has an external flange with a diameter greater than the diameter of the bag and less than the inside diameter of the container.

10. The bottle according to claim 9 wherein the extension of the neck of the container protrudes inside the flexible bag.

11. The bottle according to claim 9 wherein the neck of the flexible bag is fixed to the container between the external face of the extension and the internal wall of the container.

12. The bottle according to claim 11 wherein the internal face of the neck of the flexible bag is in contact with the external face of the extension.

13. The bottle according to claim 9 wherein the container and the bag are made of the same material.

* * * * *